US006575141B2

(12) United States Patent
Murphy

(10) Patent No.: US 6,575,141 B2
(45) Date of Patent: Jun. 10, 2003

(54) MONOCOQUE MANIFOLD ASSEMBLY

(75) Inventor: Kevin Arthur Murphy, Sterling Heights, MI (US)

(73) Assignee: Siemens VDO Automotive, Inc., Chatham (CA)

( * ) Notice: Subject to any disclaimer, the term of this patent is extended or adjusted under 35 U.S.C. 154(b) by 33 days.

(21) Appl. No.: 10/029,047

(22) Filed: Dec. 20, 2001

(65) Prior Publication Data

US 2002/0083924 A1 Jul. 4, 2002

Related U.S. Application Data

(60) Provisional application No. 60/259,637, filed on Jan. 4, 2001.

(51) Int. Cl.[7] ..... F01M 55/02
(52) U.S. Cl. ..... 123/468
(58) Field of Search ..... 123/468, 470, 123/456, 184.31, 184.53, 184.21, 184.27

(56) References Cited

U.S. PATENT DOCUMENTS 5,022,371 A * 6/1991 Daly ..... 123/468
5,163,406 A * 11/1992 Daly et al. ..... 123/184.63
5,357,931 A * 10/1994 Semence ..... 123/456
5,515,822 A * 5/1996 Kobayashi et al. .... 123/184.35
5,657,733 A 8/1997 Dozier et al.
6,192,849 B1 * 2/2001 Powell ..... 123/184.34
6,308,686 B1 * 10/2001 Mammarella et al. ..... 123/470
2001/0025627 A1 * 10/2001 Lamb et al. ..... 123/184.21

* cited by examiner

*Primary Examiner*—Thomas N. Moulis

(57) ABSTRACT

A manifold assembly comprises an air intake manifold (42) having at least one duct (70) communicating air to an engine and a fuel conduit (46) having at least one fuel injector (54A) for communicating fuel to the engine (52) (FIG. 2). The fuel conduit (46) comprises at least a first fuel injector (54A) and a second fuel injector (54B) extending from the fuel conduit (46) wherein the first fuel injector (54A) extends in a direction transverse to the second fuel injector (54B). At least one support member (50A) comprises at least one duct passage (62C) in communication with the at least one duct and at least one fuel injector port passage (53C) in communication with the at least one fuel injector (54C) (FIG. 2A). The fuel injector port passage (53C) has a predetermined length greater than the length of the duct passage (62C) (FIG. 2A).

15 Claims, 5 Drawing Sheets

MONOCOQUE MANIFOLD ASSEMBLY

This application claims priority to Provisional Patent Application Ser. No. 60/259,637, filed on Jan. 4, 2001.

BACKGROUND OF THE INVENTION

This invention relates to an air intake manifold assembly for a v-shaped engine having two banks forming a V pattern.

For such an engine, manufacturers employ air intake manifold assemblies that comprise an upper manifold portion and two lower manifold portions. A single fuel rail or conduit is frequently used to communicate fuel from a fuel tank to the combustion chambers of both banks of the engine through fuel injectors of the fuel rail. The fuel injectors that extend from the fuel rail also take a v-shaped form to meet each cylinder. Due to the proximity of the ducts of the air intake manifolds to the ports for the fuel injectors, manufacturers mold the ports and ducts together as part of the lower portion of the manifold assembly.

The manifold assembly generally consists of a pair of lower manifold portions, a fuel rail assembly, and a single upper manifold portion. The fuel rail is installed into the lower manifold portions from above. Then, the upper intake manifold is installed on top. A set of seals and additional components hold the manifold portions together. Moreover, the interface between the lower intake manifold and the engine requires another set of seals and components to assemble the lower intake manifolds to the engine.

The present design of manifold assembly has several drawbacks. The splitting of the manifold assembly into upper and lower manifold portions requires additional componentry as well as labor and time to assemble. Each portion also requires separate tooling and capital expenditures to manufacture. Finally, handling and inventory costs are increased as a consequence of the multiple components required by the current design.

A need therefore exists for a simplified manifold design that permits easy installation and service of the fuel rail and manifold assembly for a v-bank engine.

SUMMARY OF THE INVENTION

The present invention moves the location of the fuel injector ports from the air intake manifold to a separate support. In so doing, the lower portions of the air intake manifold assembly may be combined with the upper portion to form a single unit, thereby reducing the number of manifold components. As a consequence, no additional tooling is required to form the lower portions of the air intake manifold. Only a single tool to form the single unit manifold is needed. Labor and parts costs are also reduced.

The invention comprises a manifold assembly. The air intake manifold has ducts that communicate air to the engine. A single fuel rail has fuel injectors for supplying the engine with fuel. The inventive design employs a separate support having ports to receive the fuel injectors and having seals to assist in the communication of air from the air intake manifold to the engine.

The support member has duct passages in communication with the ducts of the manifold and has fuel injector port passages in communication with the fuel injectors of the fuel rail. In contrast to the prior art, the fuel injector port passages may have a predetermined length greater than the length of the duct passages. The support member may comprise a planar member. For a v-shaped engine, two support members may be used to interface the ducts and injectors of the manifold and fuel rail with each bank of the engine.

The fuel conduit may be mounted to the air intake manifold. Seals may be used between the duct passages and the ducts. These seals may be mounted to the support member. In addition, seals may be used between the duct passage and the engine. These seals may be mounted to the support member.

The air intake manifold assembly may have a planar member acting as a support comprising duct mounts in communication with the ducts of the manifold and fuel injector port mounts in communication the fuel injectors of the fuel rail. The fuel injector port mounts may have a predetermined thickness greater than the thickness of the duct mounts. Seals may be used between the duct mount and the duct and may be mounted to the planar member. Seals may also be employed between the duct mounts and the engine and mounted to the planar member.

Hence, the fuel injector ports are located separately from the air intake manifold. The support member is then mounted to the engine with each fuel injector positioned into each fuel injector port. This design then allows the air intake manifold to be mounted as a single unit on the engine.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figure 1:
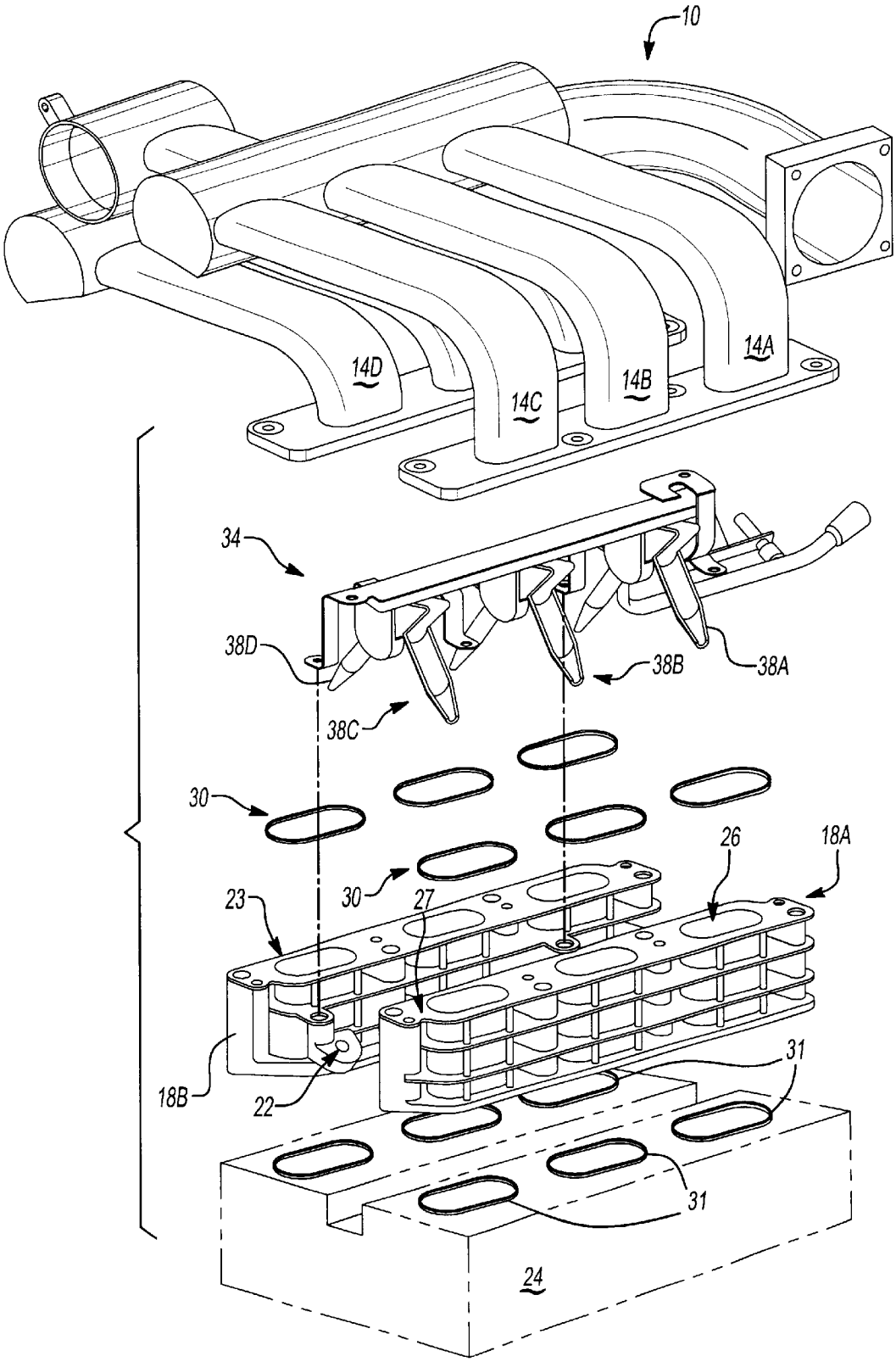
Fig-1 PRIOR ART
FIG. 1 shows a prior art manifold assembly employing an upper manifold portion and two lower manifold portions of an air intake manifold.

As shown in FIG. 1, for a v-bank engine, the prior art manifold assembly comprises single fuel rail or conduit 34, upper manifold portion 10 and lower manifold portions 18A and 18B. Upper manifold portion 10 has ducts 14A, 14B, 14C and 14D. Lower manifold portions, 18A and 18B, have ducts 26, to mount with ducts of upper manifold portion 10. Here, duct 14A mounts with duct 26 to permit the communication of air from upper manifold portion 10 through lower manifold portion 18A to engine 24 (shown schematically). This assembly has seals 30 at the interface between upper manifold portion 10 and lower manifold portions, 18A and 18B.

On lower manifold portions, 18A and 18B, fuel injector ports, such as fuel injector port 22, are located, thus combining the fuel injector ports with lower manifold portions, 18A and 18B. Fuel conduit 34 has fuel injectors such as fuel injector 38A, 38B, 38C and 38D. Due to the use of a single fuel conduit 34, fuel injector 38C extends from fuel conduit 34 in a direction transverse to the direction of extension of fuel injector 38D, thus forming an upside down v-shaped form. Each injector is inserted into a corresponding fuel injector port, such as fuel injector port 22, on each of the lower manifold portions, 18A and 18B. By locating injector ports 22 on the air induction manifold, upper manifold portion 10 must be separated from lower manifold portions 18A and 18B to permit installation of fuel conduit 34 and its subsequent service. Hence, lower manifold portions, 18A and 18B, are mounted on engine 24. Fuel conduit 34 and fuel-injectors, such as 38D, are installed into respective fuel injector ports, such as fuel injector port 22. Seals 30 are installed as known between upper manifold portion 10 and lower manifold portions, 18A and 18B. Seals 31 are installed between lower manifold portions, 18A and 18B, and engine 24. Upper manifold portion 10 is then mounted to lower manifold portions 18A and 18B.

Figure 1A:
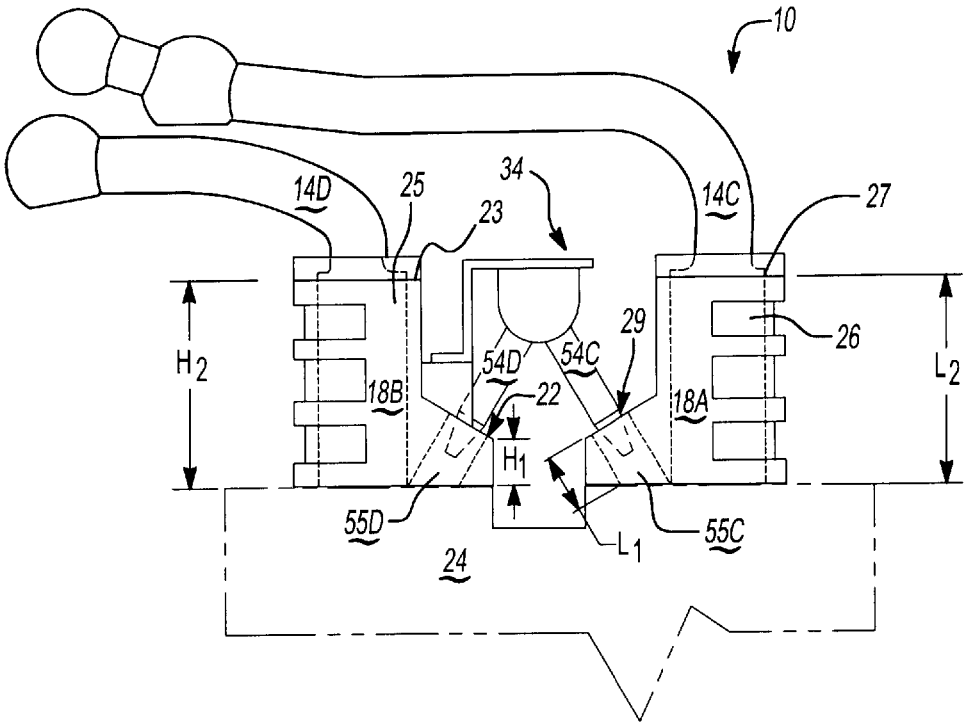
Fig-1A PRIOR ART
FIG. 1A shows another view of the prior art manifold assembly of FIG. 1.

FIG. 1A shows another view of the manifold assembly of FIG. 1. Duct 14D and duct 14C mount to lower manifold portions 18B and 18A, respectively, and communicate air to engine 24 through duct passages 25 and 26. Duct upper faces 23 and 27 act as interfaces between ducts 14D and 14C and duct passages 25 and 26. Thus, for example, duct 14D mounts to duct mount 23 of lower manifold portion 18B, permitting air to pass through duct passage 25 to engine 24. Both ducts mounts 23 and 27 have a height H2.

Fuel rail 34 has fuel injectors 54D and 54C, which are disposed in fuel injector passages, 55D and 55C, respectively. Fuel ports mounts 22 and 29, like other port mounts of the assembly, have a minimum height H1 to meet fuel injector 54D and 54C. As shown, height H1 of fuel injector port 22, is less than height H2 of duct upper face 23. Also, fuel injector passage 55C has a length L1 less than the length L2 of duct passage 26.

Figure 2A:
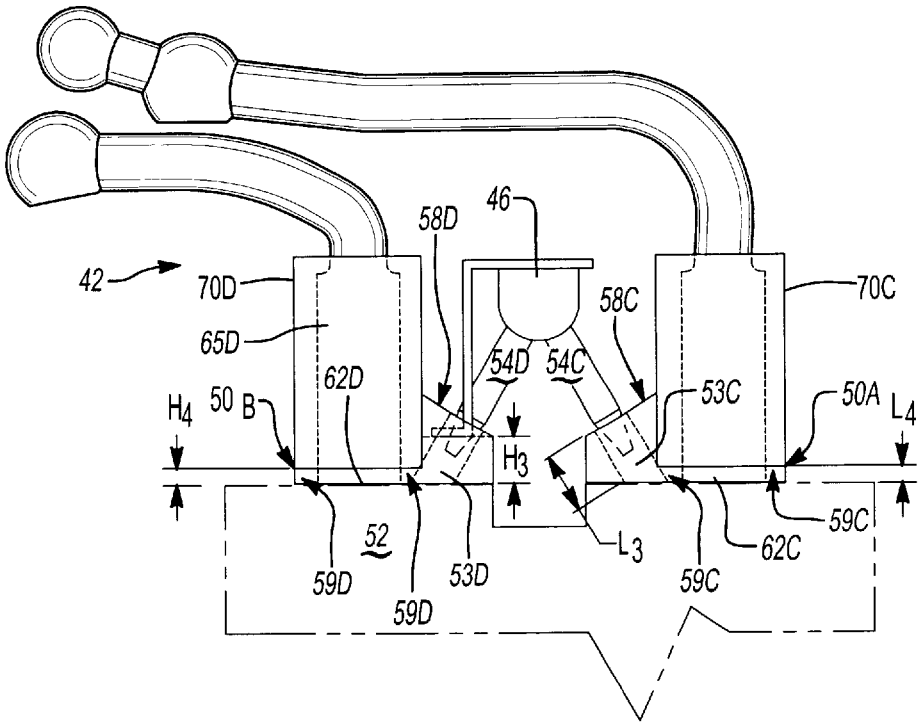
FIG. 2A shows another view of the embodiment of FIG. 2, highlighting the fuel injector port passages, fuel injector port mounts, and duct passages and duct mounts.
Figure 2:
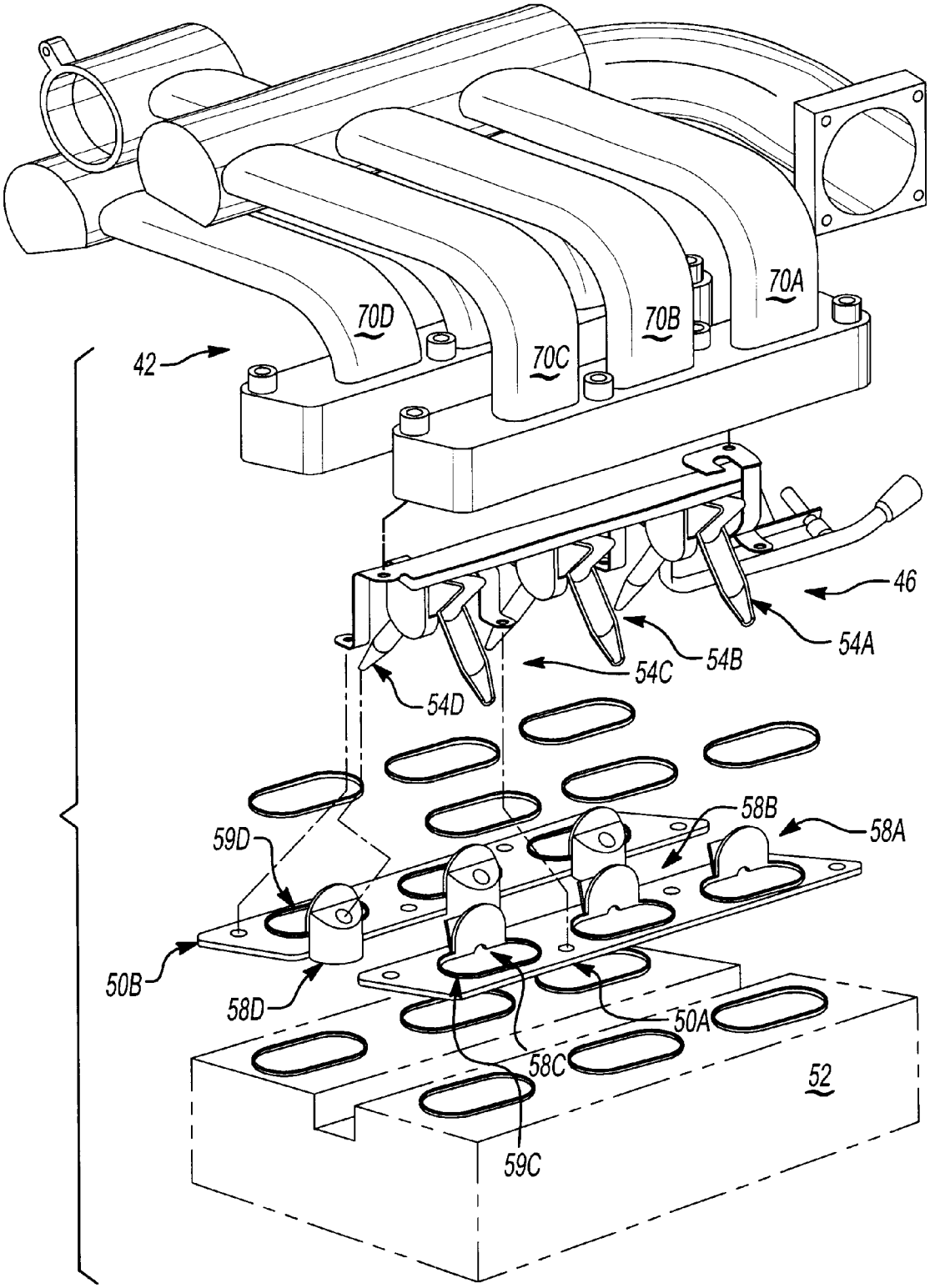
FIG. 2 illustrates an embodiment of the invention, including an air intake manifold, fuel conduit, and the support member with fuel injector ports passages and duct passages.

FIG. 2 illustrates an embodiment of the invention, including air intake manifold 42, fuel conduit 46, and support members, 50A and 50B. As shown, air intake manifold 42 comprises a single unit communicating air to a vehicle engine through ducts such as 70A, 70B, 70C and 70D. Fuel rail 46 is mountable to air intake manifold 42, and has fuel injectors 54A, 54B, 54C, and 54D, which have a v-shaped form as shown with fuel injectors 54C and 54D.

In contrast to the prior art, support member 50A and support member 50B may comprise a planar member. Each support member also has fuel injector port mounts, such as fuel injector port mounts 58A, 58B, 58C, and 58D that may comprise columns with passages to receive the fuel injector nozzles. Also, support members 50A and 50B have duct mounts, such as 59D and 59C, with passages.

As shown in FIG. 2A, support members, 50A and 50B, each have fuel injector passages, such as 53D and 53C, which receive fuel injectors, 54D and 54C, respectively. Unlike the prior art, however, fuel injector passages, 53D and 53C, have a minimum length L3 greater than the length L4 of duct passages, 62D and 62C. Moreover, fuel injector port mounts, such as fuel injector port mounts, 58D and 58C, have a minimum height H3, which is greater than the height H4, to the upper face of duct mounts, 59D and 59C.

Location of the ports on a support member separate from air intake manifold 42 permits the employment of a single unit manifold body while still permitting easy installation and subsequent service of fuel conduit 46. The manifold assembly is then installed on an engine by mounting support member 50A and 50B to each respective bank of engine 52. Fuel conduit 46 is oriented to allow fuel injectors 54A, 54B, 54C and 54D to be received respectively by fuel injector port mounts 58A, 58B, 58C and 58D. Fuel rail 46 is then mounted as known to air intake manifold 42. Air intake manifold 42 is mounted to engine 52 through support members 50A and 50B. As shown in FIG. 2A, duct 70D interfaces with duct mount 59D while duct 70C interfaces with duct mount 59C. The ducts may be mounted as known. Accordingly, the invention avoids the use of additional components found in the prior art. Moreover, air intake manifold 42 may be constructed using a single tool rather than multiple tools. Assembly and handling of these components is thereby simplified.

Figure 3:
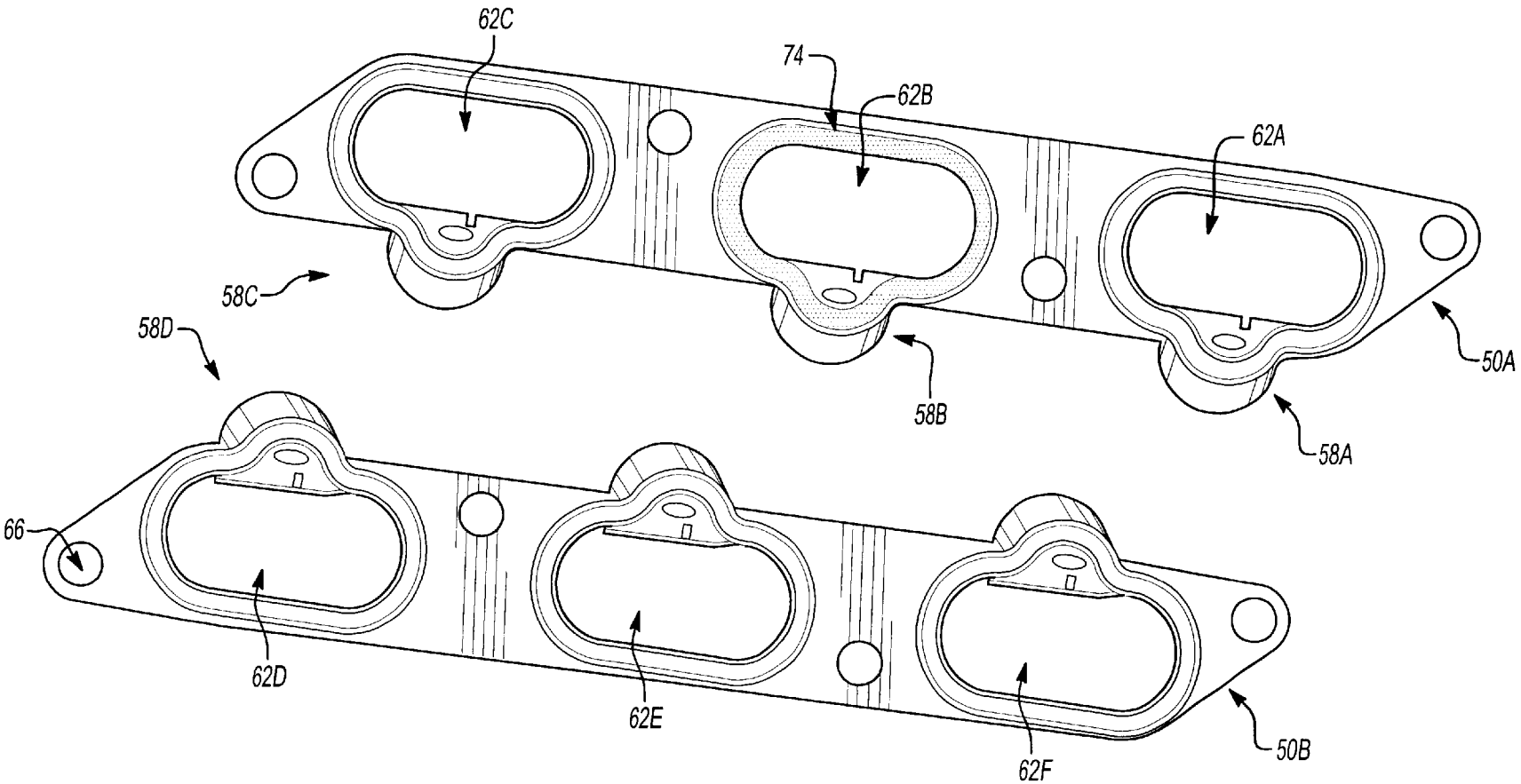
FIG. 3 illustrates the support member of FIG. 2.

FIG. 3 illustrates an underside view of support members 50A and 50B of FIG. 1. Shown from this view are duct passages 62A, 62B, 62C, 62D, 62E and 62F to permit communication of air from ducts, such as duct 70A, 70B, 70C and 70D, as shown in FIG. 2 to vehicle engine 52. Seals, such as seal 74, may be provided around each duct passage to assist in the flow of air to engine 52. Also, as shown in FIG. 2, seals, such as seals 59D and 59C, may be employed between support members, 50A and 50B, and ducts, 70D and 70C.

Figure 4:
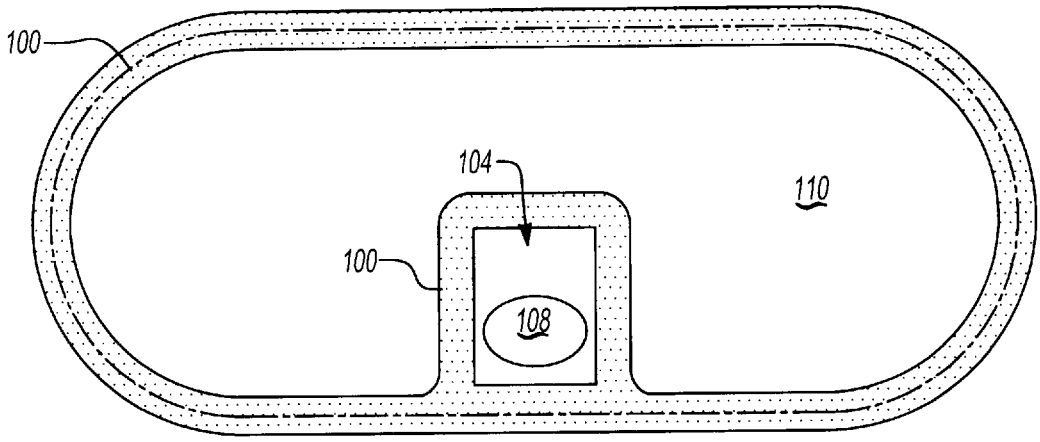
FIG. 4 illustrates a plan view of another embodiment of the invention.
Figure 5:
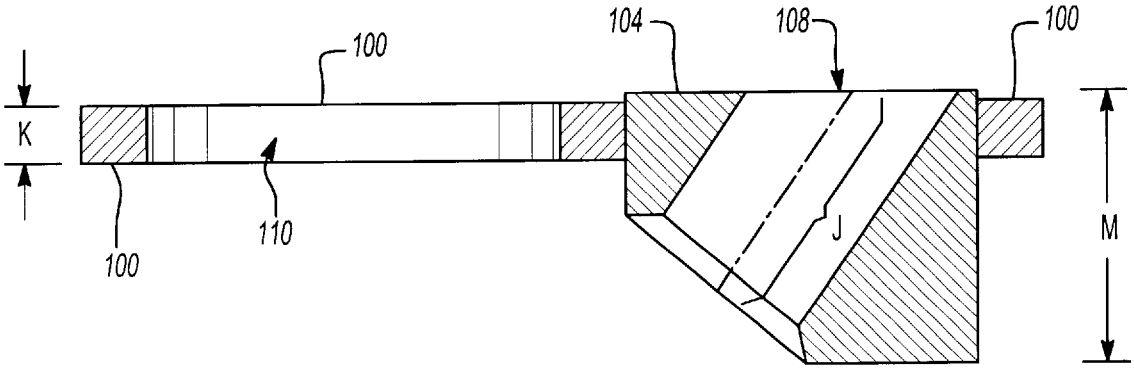
FIG. 5 illustrates a cross-sectional view of the embodiment of FIG. 4.
Figure 6:
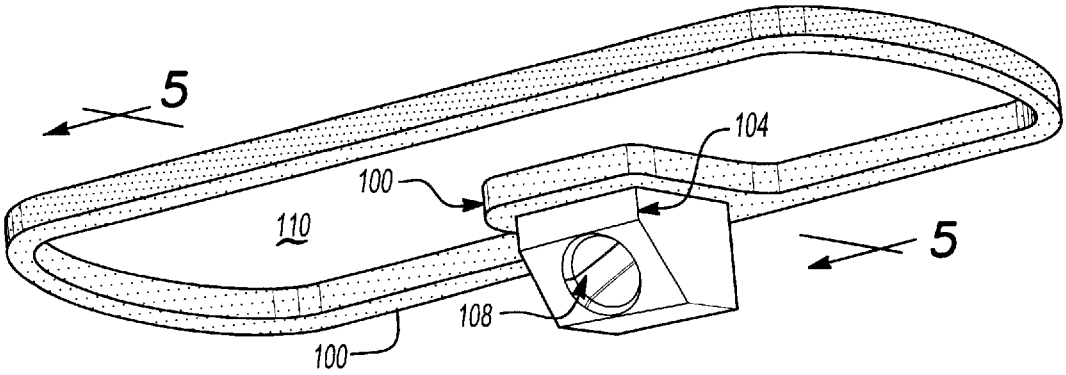
FIG. 6 illustrates a perspective view of the embodiment of FIG. 4.

An alternative concept to the support member would be to overmold the injector ports with elastomer. Rather than have a planar support member for duct seals and fuel injector port mounts, duct seals and fuel injector port mounts may be individually employed. FIGS. 4, 5 and 6 illustrate such an embodiment. FIG. 4 shows a plan view of this embodiment comprising injector port mount 104 and seal 100. Seal 100 may be an elastomer seal molded as known with injector port mount 104 to provide a sealing surface between say duct 70D and vehicle engine 52. Injector port mount 104 has injector port passage 108 to receive a fuel injector and assist in the communication of fuel to vehicle engine 52. Injector port mount 104 may be supported as known. An injector port mount and seal would be provided for each individual duct, providing a cheaper way to interface the fuel injectors and manifold ducts with the vehicle engine.

FIG. 5 illustrates a cross-sectional view of the embodiment of FIG. 4. In particular, FIG. 5 shows that the length (also height) K of duct passage 110 is less than the length J of fuel injector port passage 108. The height, K, of seal 100 is also less than the height, M, of fuel injector port mount 104. FIG. 5 also highlights seal 100 extending around injector port mount 104. This sealing of injector port mount 104 is also shown in FIG. 6. This seal ensures sufficient communication of air from duct to vehicle engine. Seals may thus be of carrier gasket or individual port design. It is simply desirable that the port be part of the seal and not the manifold.

This disclosure shows the invention employed with a v-bank engine. The v-bank engine may comprise a central v-bank, external v-bank, or other v-bank engine. Additionally, the invention may be employed with a single line engine as well.

Finally, the concept is depicted for a molded composite manifold, which may be produced by shell, lost core or hybrid construction. Details surrounding the manufacture of these manifolds are well known. The invention may also be employed for a metal manifold.

The aforementioned description is exemplary rather than limiting. Many modifications and variations of the present invention are possible in light of the above teaching. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason, the following claims should be studied to determine the true scope and content of this invention.

We claim:

1. A manifold assembly comprising:

an air intake manifold having at least one duct communicating air to an engine;

a fuel conduit having at least one fuel injector for communicating fuel to said engine wherein said fuel conduit comprises at least a first fuel injector and a second fuel injector extending from said fuel conduit wherein said first fuel injector extends in a direction transverse to said second fuel injector; and at least one support member comprising at least one duct passage in communication with said at least one duct and at least one fuel injector port passage in communication with said at least one fuel injector wherein said fuel injector port passage has a predetermined length greater than the length of said duct passage in said support member.

2. The manifold assembly of claim 1 wherein said support member comprises a fuel injector port mount encompassing said fuel injector port passage and a seal encompassing said duct passage operatively connected to said fuel injector port mount.

3. The manifold assembly of claim 1 wherein said support member comprises a generally planar member.

4. The manifold assembly of claim 1 wherein said fuel conduit is mounted to said air in take manifold.

5. The manifold assembly of claim 1 wherein said at least one support member comprises a first support member and a second support member wherein said first support member comprises at least one fuel injector port passage in communication with said first fuel injector and said second support member comprises at least one fuel injector port passage in communication with said second fuel injector.

6. The manifold assembly of claim 1 including a seal between said duct passage and said duct.

7. The manifold assembly of claim 6 wherein said seal is mounted to said support member.

8. The manifold assembly of claim 1 including a seal between said duct passage and said engine.

9. A manifold assembly comprising:

an air intake manifold having at least one duct communicating air to an engine;

a fuel conduit having at least one fuel injector for communicating fuel to said engine wherein said fuel conduit comprises at least a first fuel injector and a second fuel injector extending from said fuel conduit wherein said first fuel injector extends in a direction transverse to said second fuel injector; and at least one planar member comprising an upper face duct mount in communication with said at least one duct and at least one fuel injector port mount in communication with said at least one fuel injector wherein said fuel injector port mount has a predetermined thickness greater than the thickness of said planar member between said upper face and a lower face.

10. The manifold assembly of claim 9 wherein said fuel conduit is mounted to said air intake manifold.

11. The manifold assembly of claim 9 wherein said at least one support member comprises a first support member and a second support member wherein said first support member comprises at least one fuel injector port mount in communication with said first fuel injector and said second support member comprises at least one fuel injector port mount in communication with said second fuel injector.

12. The manifold assembly of claim 9 including a seal between said duct mount and said duct.

13. The manifold assembly of claim 12 wherein said seal is mounted to said planar member.

14. The manifold assembly of claim 9 including a seal between said duct mount and said engine.

15. The manifold assembly of claim 14 wherein said seal is mounted to said support member.

* * * * *